US006123029A

United States Patent [19]

Mobley

[11] Patent Number: 6,123,029

[45] Date of Patent: Sep. 26, 2000

[54] INTERMODAL TRANSPORT SYSTEM

[76] Inventor: Joseph T. Mobley, 1256 NC 241, Pink Hill, N.C. 28572

[21] Appl. No.: 09/053,056

[22] Filed: Apr. 1, 1998

[51] Int. Cl.[7] ..... B61D 17/00

[52] U.S. Cl. ..... 105/4.1; 105/4.2; 105/34.1; 105/34.2; 105/133; 105/175.1; 104/29; 104/31; 104/48

[58] Field of Search ..... 104/29, 27, 31, 104/48, 130.06; 105/3, 4.1, 4.2, 26.05, 34.1, 34.2, 72.2, 159, 175.1, 176, 133

[56] References Cited

U.S. PATENT DOCUMENTS

| | | | |
|---|---|---|---|
| 2,012,260 | 8/1935 | Martin | 105/34.1 |
| 2,051,074 | 8/1936 | Borrows et al. | 105/34.1 |
| 2,111,676 | 3/1938 | Ritchie | 105/4.2 |
| 3,557,707 | 1/1971 | Joy | 105/3 |
| 3,678,864 | 7/1972 | Gutridge | 105/4.1 |
| 3,756,159 | 9/1973 | Sternad | 104/48 |
| 4,416,571 | 11/1983 | Krause | 410/53 |
| 4,547,107 | 10/1985 | Krause | 105/4.2 |
| 4,653,966 | 3/1987 | Bakka et al. | 410/1 |
| 4,773,336 | 9/1988 | Orb | 105/199.4 |
| 5,016,544 | 5/1991 | Woollam | 105/215.2 |
| 5,017,064 | 5/1991 | Kirwan | 410/53 |
| 5,020,445 | 6/1991 | Adams, Jr. | 105/4.1 |
| 5,107,772 | 4/1992 | Viens | 105/159 |
| 5,431,110 | 7/1995 | Adams, Jr. | 105/4.1 |
| 5,537,931 | 7/1996 | Donkin | 105/159 |
| 5,601,030 | 2/1997 | Brouillette | 105/159 |
| 5,619,931 | 4/1997 | Madison | 105/72.2 |

FOREIGN PATENT DOCUMENTS

| | | | |
|---|---|---|---|
| 16687 | 3/1956 | Germany | 105/4.1 |

*Primary Examiner*—Mark T. Le
*Attorney, Agent, or Firm*—Mills Law Firm PLLC

[57] ABSTRACT

An improved intermodal transport system combining trucking and railway technology for the transport of passengers and freight. The present system includes a so-called Super Rail Train which incorporates an automotive truck drive system and components in a fuel efficient power vehicle which replaces the conventional locomotive. The present system also includes a plurality of secondary power units having an automotive truck drive system which are operated only during peak load conditions. The present system features a self-powered tandem device which replaces the conventional railroad dolly or bogie used in the transport of highway semi-trailer containers by rail and permits movement of a partially assembled train without a switching engine. A further feature of the present invention provides a switching ramp which is installed at truck/train terminals to facilitate the efficient assembly and breakdown of the train upon arrival at a destination for rerouting semi-trailer containers to highway use.

13 Claims, 15 Drawing Sheets

INTERMODAL TRANSPORT SYSTEM

BACKGROUND OF INVENTION

1. Field of Invention

This invention relates generally to intermodal transport systems and, more particularly, to an improved truck-train system for transporting both passengers and freight by railway.

Intermodal transport systems utilizing a combination of truck-train technology are well known to those skilled in the art. Many state and local governments have enacted legislation which taxes and regulates truck traffic to reduce road damage and traffic accidents.

To overcome these disadvantages the industry has devised many systems for combining truck-trailers with railroad equipment. Historically the first of these systems utilized railroad flatcars to carry truck-trailers in a so-called piggyback method which eliminated to need to unload the contents of the truck-trailer.

It was soon recognized that the flatcar could be eliminated entirely and replaced by a railway dolly or so-called bogie. For example, U.S. Pat. No. 4,653,966 discloses such a system wherein a semi-trailer is driven onto a bogie. However, such a system requires a large truck turning area and a high degree of driver skill to accomplish the loading process. This system requires a separate incline ramp to load the trailer onto the dolly and if a separate incline ramp is not available at the destination, the trailer cannot be unloaded.

Another system is disclosed in U.S. Pat. No. 5,107,772 that uses a railway bogie incorporating a platform and pivot pin adapted to connect directly to a truck-trailer. The platform is raised by a pneumatic system integrated into the bogie to couple it to the underside of the trailer.

All of the prior art truck-train systems utilizing railway dollies or bogies have proven to be less than desirable by requiring additional equipment for their operation such as special lifting cranes necessary to mount the truck-trailers on the railway dollies and separate switching engines for moving the truck-trailers once they have been installed on a dolly.

Further, many of the prior art truck-train systems require the use of a railroad turntable device and a complex loading area to link the truck-trailers together for transport.

Thus, the Improved Intermodal Transport System of the present invention has been developed to overcome the deficiencies in prior art truck-train systems.

2. Description of Related Prior Art

U.S. Pat. No. 4,653,966 to Bakka et al. discloses a truck-train system wherein a semi-trailer is driven onto a bogie. Such a system requires a large truck turning area, a separate incline ramp, and a high degree of driver skill to accomplish the loading process. Further, if a separate incline rail is not available at the destination, the trailers cannot be unloaded.

U.S. Pat. No. 5,107,772 to Jacques Viens discloses a rail bogie for transporting semi-trailers comprising a truck having a wheel-mounted chassis and a fifth wheel frame above the chassis. Power jacks or inflatable balloons are mounted between this chassis and the frame for moving the latter vertically between a low and a high position relative to the chassis. The frame is raised by a pneumatic system to couple it to the underside of the trailer.

U.S. Pat. No. 4,416,571 to Robert A. Krause discloses a truck and rail transportation system wherein an elongated truck container can be carried either by rail or on a highway by a conventional truck tractor. The container includes a pair of dolly engaging pins fixed to its floor at the opposite ends thereof. The pins are adapted to engage a fifth wheel mechanism mounted on a dolly having wheels thereon adapted to engage conventional railroad rails.

U.S. Pat. No. 5,431,110 to George W. Adams discloses a truck-train system that provides for the mounting and dismounting of a truck-trailer from a railway dolly employing a moment arm reaction locking mechanism that automatically centers and engages the truck-trailer in position on the railway dolly.

U.S. Pat. No. 5,020,445 to George W. Adams discloses a truck-trail system wherein a railway dolly or bogie is utilized to support the front end of one truck-trailer and the rear end of another truck-trailer. A pair of truck-trailer support members are pivotally connected to the railway dolly. They are provided with a fixed incline ramp to raise and guide the truck-trailer onto the respective support member. The railway dolly is provided with a pair of fifth wheel mechanisms and standard railway couplers at each end.

U.S. Pat. No. 5,601,030 to Michael F. Brouillette discloses a railroad bogie with a pneumatic system and lifting mechanism for connecting truck-trailers in an articulated train. The bogie functions to lift the rear end and the front end of adjacent truck trailers respectively off the ground for transport by rail.

U.S. Pat. No. 4,773,336 to Robert M. Orb discloses a road/rail transport system comprising rail bogies of the kind having two axles and being attachable to a semi-trailer to convert the same to railroad travel.

U.S. Pat. No. 5,537,931 to Thomas G. Donkin discloses a rail bogie for connection with an intermodal or rail highway trailer having convention highway wheels. The rail bogie includes an adapter engageable with a trailer and incorporates a lift mechanism for enabling the adapter to be lowered or collapsed for insertion beneath a trailer for raising the trailer wheels off the ground.

U.S. Pat. No. 5,017,064 to George B. Kirwan et al. discloses an intermodal transport system designed for use in hauling semi-trailers by means of railway bogies. The system combines a turntable and spring-loaded chock design to enable the efficient loading and unloading of semi-trailers.

U.S. Pat. No. 5,016,544 to Ronald F. Woollam discloses a convertible road/rail power vehicle including a tractor unit provided with retractable wheel sets and rail equipment that enable it to operated on either highways or railway tracks and when on rail to pull a plurality of railway cars.

Finally, U.S. Pat. No. 5,619,931 to Harry Madison discloses a road and rail vehicle having a truck tractor vehicle frame such that it is street legal, but also provides sufficient power to move freight cars on low density rail lines or at other desired locations. The vehicle has a transfer case to provide front wheel drive by road wheels when the vehicle is in a highway mode and to provide rear wheel drive by rail wheels when in a rail mode.

SUMMARY OF THE INVENTION

After much research and study of the disadvantages of the prior art systems, the present invention has been developed to provide an improved intermodal transport system which combines trucking and railway technology for the transport of passengers and freight in combination. The Super Rail System of the present invention integrates highway truck drive system components into powered vehicles suitable for pulling a combination of passenger coaches and highway type trailer containers by rail.

The Super Rail Train of the present invention differs significantly from the truck-train systems of the prior art in that the dollies or so-called bogie devices are replaced by a plurality of secondary drive units that are provided with computer controlled truck power systems which can be selectively operated during peak loads such as on rising grades when the Super Rail Train is in operation. Thus, the Super Rail Train can be operated with much greater fuel efficiency than conventional multiple locomotive trains.

In addition, the present Super Rail System includes a plurality of versatile tandem vehicles that interconnect the semi-trailer containers and are also self-powered which facilitates the assembly and disassembly of the Super Rail Train.

In view of the above, it is an object of the present invention to provide an improved intermodal transport system or Super Rail System which combines both trucking and railway technology and components.

Another object of the present invention is to provide an improved intermodal transport system which is capable of transporting both passenger coaches and truck trailer containers in the same train.

Another object of the present invention is to provide a Super Rail Train wherein primary and secondary drive vehicles are provided with highway truck running gear to improve fuel efficiency and to reduce maintenance and repair costs.

Another object of the present invention is to provide a Super Rail System wherein a plurality of self-powered secondary drive vehicles replace the conventional bogie devices that interconnect the passenger coaches within the train and which can be operated during peak loads such as rising grades by an on-board computer system.

Another object of the present invention is to provide a plurality of self-powered tandem devices which are capable of independent operation during the hitching and unhitching process to break down the train at its destination.

Another object of the present invention is to provide a Super Rail System wherein pre-existing highway truck-trailers can be retrofitted with attaching hardware so as to be capable of adaptation to the present system.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1A:
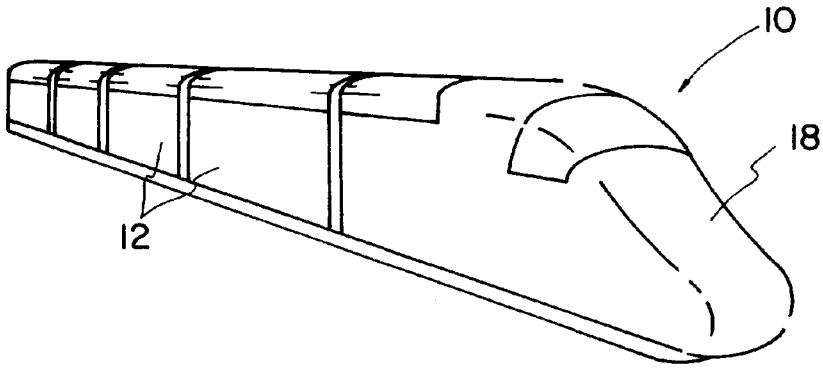
FIG. 1A is a perspective view of a preferred embodiment of the Super Rail Train of the present system showing a single primary drive vehicle attached thereto.

With reference to the drawings there is shown therein a Super Rail Train which forms a part of the present invention, indicated generally at 10 and illustrated in FIG. 1A. The embodiment shown in FIG. 1A is a passenger/freight train having a total capacity of 370 passengers and capable of pulling 20 highway trailer containers at a time. The passengers are transported in a plurality of passenger coaches 12 having all of the amenities comparable to conventional passenger trains.

Figure 1B:
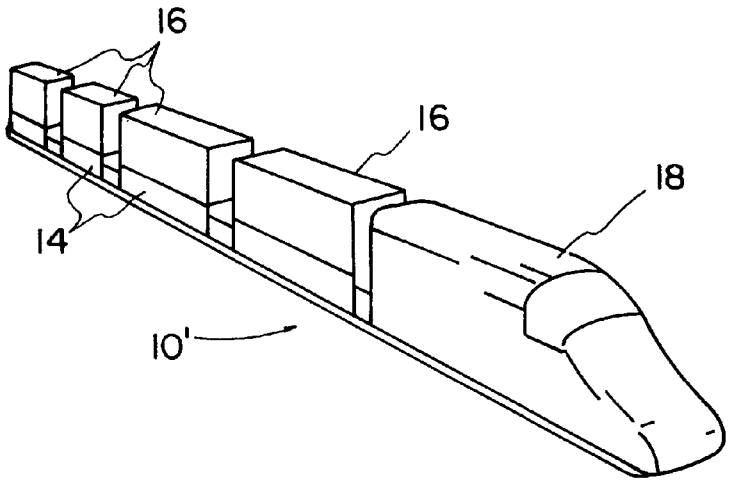
FIG. 1B is an alternative embodiment of the Super Rail Train of the present system adapted for transporting freight containers on flat cars.

In an alternative embodiment shown in FIG. 1B, another passenger/freight train 10' is depicted wherein the passenger coaches have been replaced by a plurality of flat cars 14 carrying freight containers 16 which are pulled by a primary drive vehicle 18.

Figure 1C:
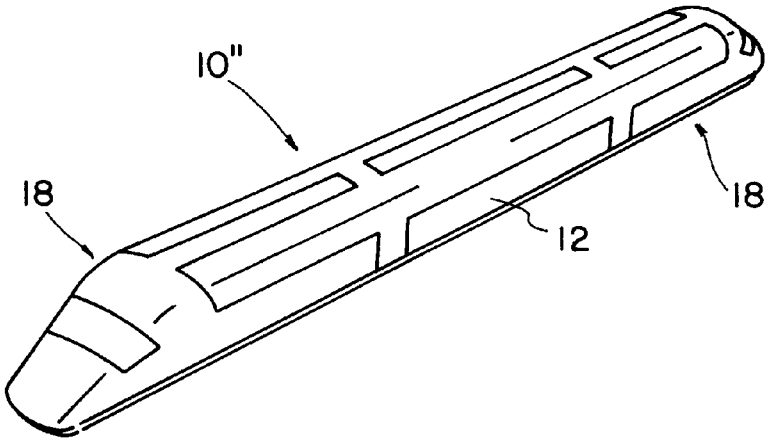
FIG. 1C is a perspective view of an alternative embodiment of the Super Rail Train of the present system having a primary drive vehicle attached at either end thereof for bidirectional operation.

In yet another alternative embodiment of the Super Rail Train as shown in FIG. 1C, a mass transit train 10" is depicted having a pair of primary drive vehicles 18 disposed at either end of the train for bidirectional transport on a typical commuter run.

Figure 2A:
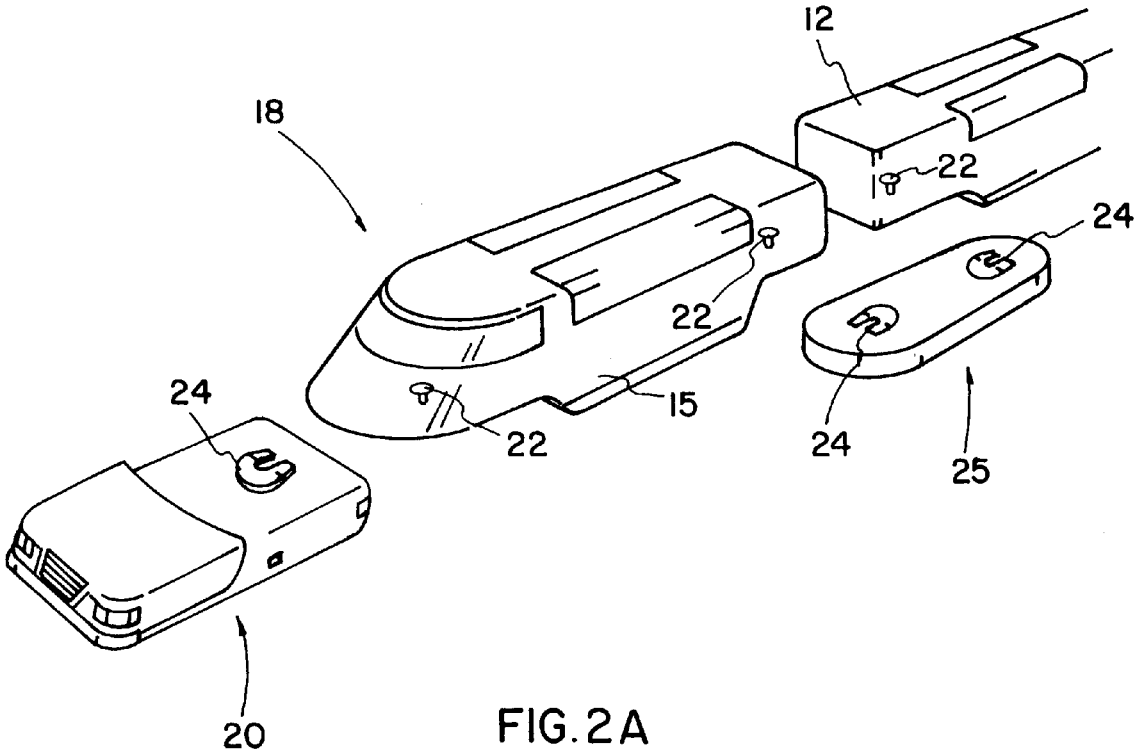
FIG. 2A is an exploded perspective view of the primary drive vehicle as shown in FIG. 1A showing both a lead drive unit and a secondary drive unit.

As more clearly shown in FIG. 2A the primary drive vehicle 18 includes a lead drive unit, indicated generally at 20 having a diesel engine, transmission, and a plurality of truck type drive axles, which is mechanically coupled to the forward passenger cab 15 by a kingpin 22 disposed on a bottom surface of the front end of the cab 15 engaging a so-called fifth wheel unit 24 carried on the lead drive unit 20.

Figure 2B:
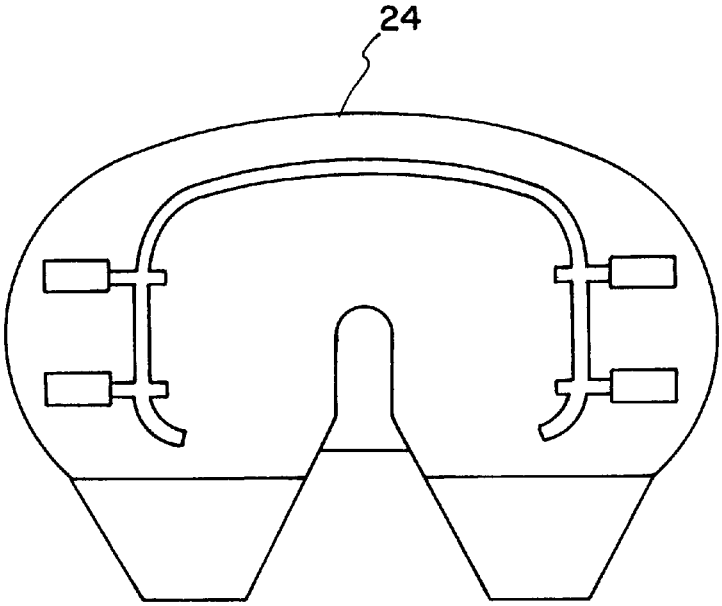
FIG. 2B is a plan view of a fifth wheel unit utilized in the present invention.

The specific construction of the fifth wheel unit 24 does not form an integral part of the present invention. However, in order to facilitate the loading and unloading procedure, of the present system, the fifth wheel units 24 are preferably of a type manufactured under the trade name Simplex Lite manufactured by American Steel Foundries, East Chicago, Ind. and illustrated in FIG. 2B.

Since such fifth wheel units are well known to those skilled in the art, further detailed discussion of the same is not deemed necessary.

A secondary drive unit, indicated generally at 25, interconnects the passenger cab 13 with the adjacent passenger coach 12 by use of kingpins 22 carried thereon which also engage fifth wheel units 24 carried on either end of the secondary drive unit 25 as shown in FIG. 2A.

It will be understood that the secondary drive unit 25 is also provided with a diesel engine, transmission, and a plurality of truck drive axles to provide additional tractive effort for the train under peak load situations such as climbing grades as hereinafter described.

Figure 2C:
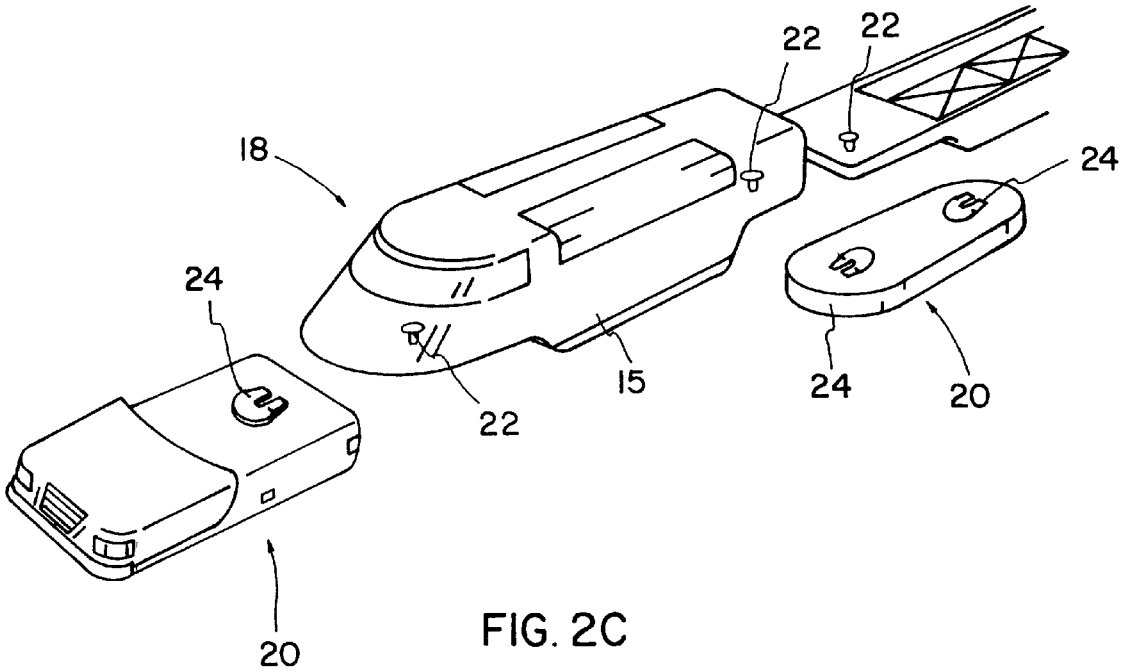
FIG. 2C is an exploded perspective view of an alternative embodiment of the Super Rail Train showing a railroad flatcar being coupled to the primary drive vehicle by a secondary drive unit.

It will be appreciated by those skilled in the art that the secondary drive unit 25 can also serve to interconnect the forward cab 13 with an adjacent flatcar 14 in the train configuration shown in FIG. 2C.

Figure 3A:
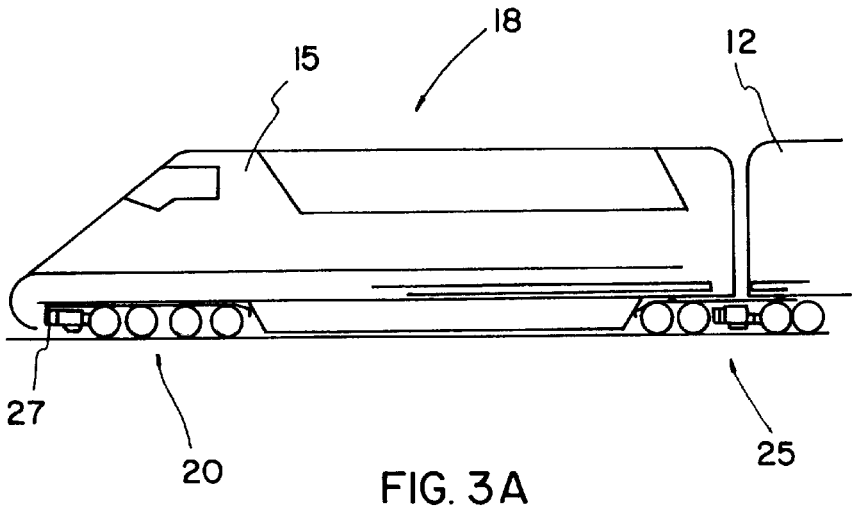
FIG. 3A is side elevational view of the primary drive vehicle generally showing the configuration of the drive system components in the lead drive unit and the secondary drive unit.
Figure 3B:
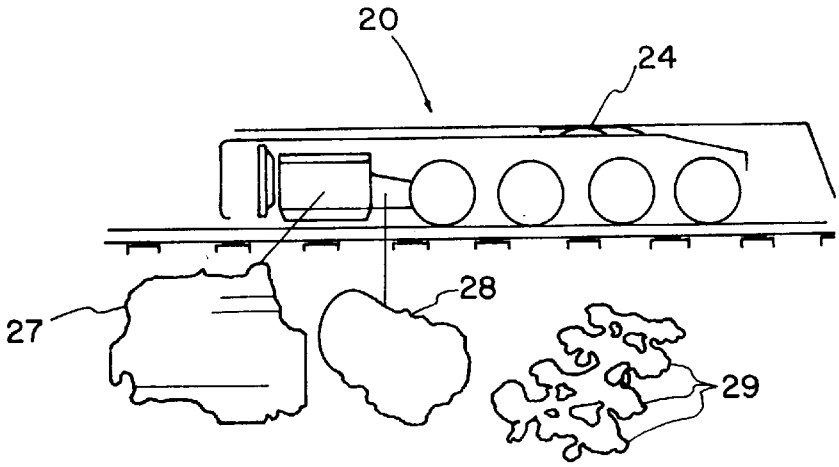
FIG. 3B is an enlarged schematic view of the lead drive unit showing the arrangement of the drive system components thereof.

Critical to the present invention is the incorporation of conventional truck drive system components into both the lead drive unit 20 and the secondary drive unit 25 of the Super Rail Train. As more clearly shown in FIGS. 3A and 3B the lead drive unit 20 includes a conventional truck engine such as a 600 hp Cummins Diesel and a computer controlled transmission 28 such as an Allison transmission which are operatively connected to a plurality of truck type drive axles 29 having a power divider unit (not shown) operatively connected thereto. The engine 27, transmission 28, and drive axles 29 are arranged front to back as shown in FIG. 3B in the manner of a conventional truck drive system having rear wheel drive.

Figure 4:
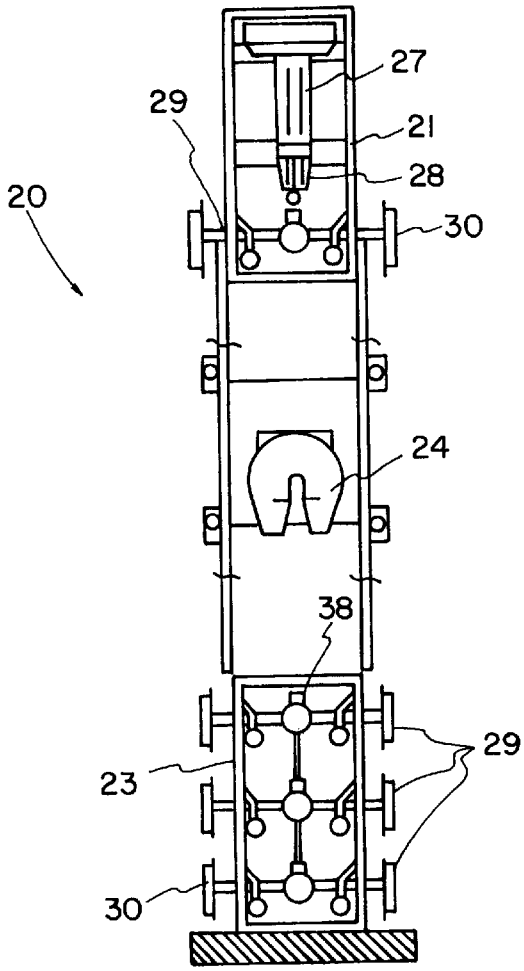
FIG. 4 is an exploded plan view of the lead drive unit showing the arrangement of the front and rear modular frames.

Further details of the construction of the primary drive unit 20 are shown in FIG. 4. The engine 27, transmission 28 and the forward drive axle 29 are integrated into a modular frame system indicated generally at 21. It will be appreciated by those skilled in the art that the engine 27, transmission 28, and forward drive axle 29 can be removed from the lead drive unit 20 as an assembly to facilitate overhaul of the drive unit 20 in the shop and to reduce down time for repairs by replacing the entire module frame 21 as a unit. Similarly, a rear modular frame 23 containing a plurality of drive axles 29 may be removed from the drive unit 20 as an assembly to facilitate repair.

The removal of both modular frames 21 and 23 is facilitated by the use of quick connect/disconnect fittings (not shown) for the on-board fuel, electrical, pneumatic, hydraulic, and coolant systems of the primary drive vehicle 18.

Since such quick connect/disconnect fittings are well known to those skilled in the art, further detailed discussion of the same is not deemed necessary.

Figure 5:
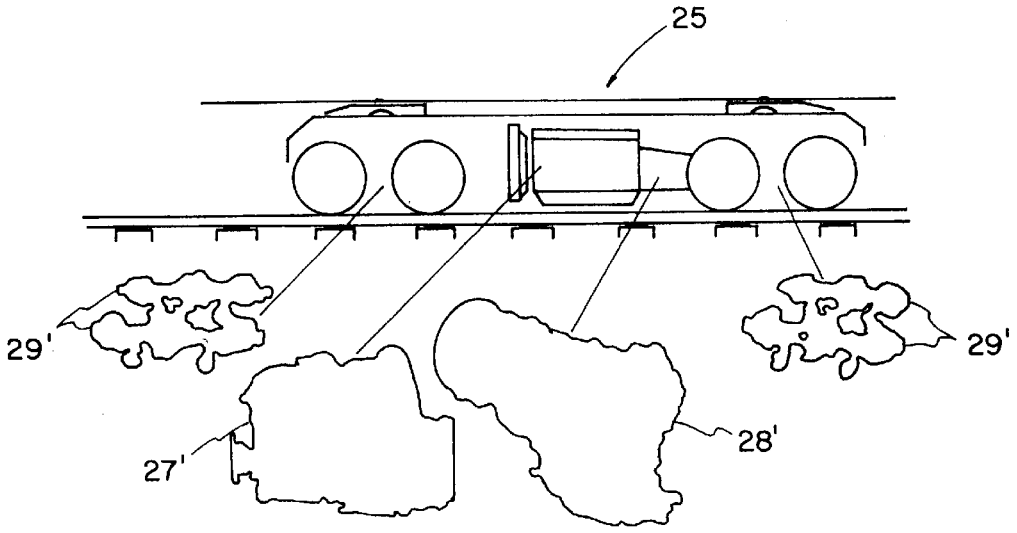
FIG. 5 is an enlarged schematic view of the secondary drive unit showing the configuration of the drive system components.

Referring now to FIG. 5 there is shown therein a secondary drive unit 25 which is utilized in the present system to interconnect the primary drive vehicle 18 with an adjacent passenger coach 12, flatcar 14, or highway trailer 15 within the train. The drive system of the secondary drive unit 25 differs substantially from that of the lead drive unit 20 in that the engine 27' and the transmission 28' are disposed intermediate a pair of drive axles 29' situated at either end of the unit. In this configuration the output of the transmission 28' is operatively connected to each of the pairs of drive axles 29' such that both sets of axles provide tractive effort when the secondary drive unit 25 is operating.

Figure 6:
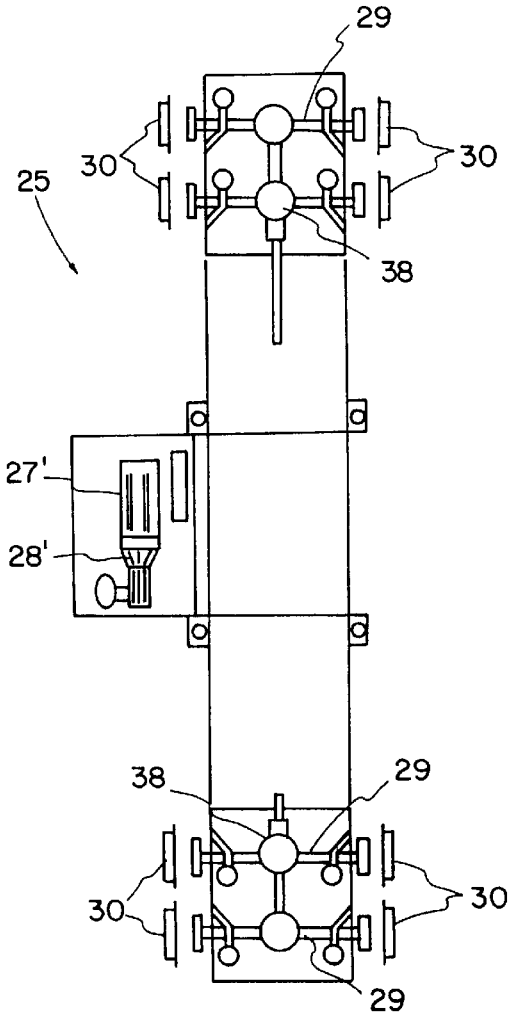
FIG. 6 is an exploded plan view showing the arrangement of the drive system components within the secondary drive unit.

Further details of the construction of the secondary drive unit 25 are shown in FIG. 6. The secondary drive unit 25 is operated only during peak load conditions such as when the train starts from a dead stop or when climbing uphill grades to provide maximum tractive effort.

The output functions of the primary drive vehicle 18 are monitored by an on-board computer (not shown) and the operating characteristics of both the lead drive unit 20 and the secondary drive unit 25 are changed in response to increased loads on the train. Thus, the secondary drive unit 25 may be activated when the output of the lead drive unit 20 is insufficient to maintain the train at a desired speed. The selective operation of the secondary drive unit 25 during peak load conditions reduces fuel consumption and maintenance on the primary drive unit 20 providing obvious economic advantages.

It will be appreciated by those skilled in the art that the use of the conventional truck drive system in both the lead drive unit 20 and the secondary drive units 25 overcomes inherent mechanical disadvantages of the conventional locomotive drive train.

Figure 7:
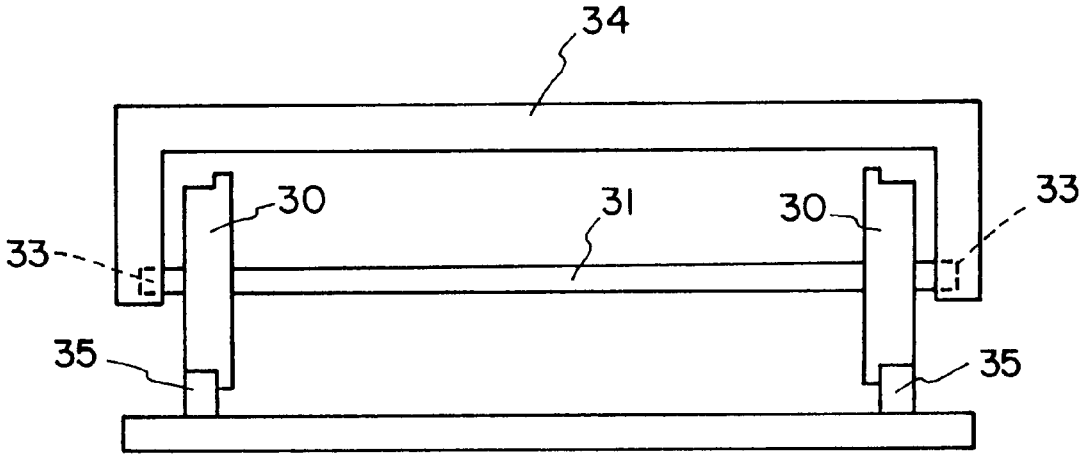
FIG. 7 is a front elevational view of a conventional railroad wheel and axle assembly disposed on a railroad track.

Initially, a fundamental problem which occurs in the standard railroad axle and wheels will be explained with reference to FIG. 7 wherein such a standard railroad axle 31 is illustrated. The conventional railroad axle 31 and wheels 30 are a solid, unitary construction. The standard train wheels 30 are rigidly attached to the axle 31 and bearings 33 are disposed at either end of the axle 31 being installed in the supporting frame 34 of a conventional locomotive, railroad car, or so-called bogie device (not shown).

Figure 8:
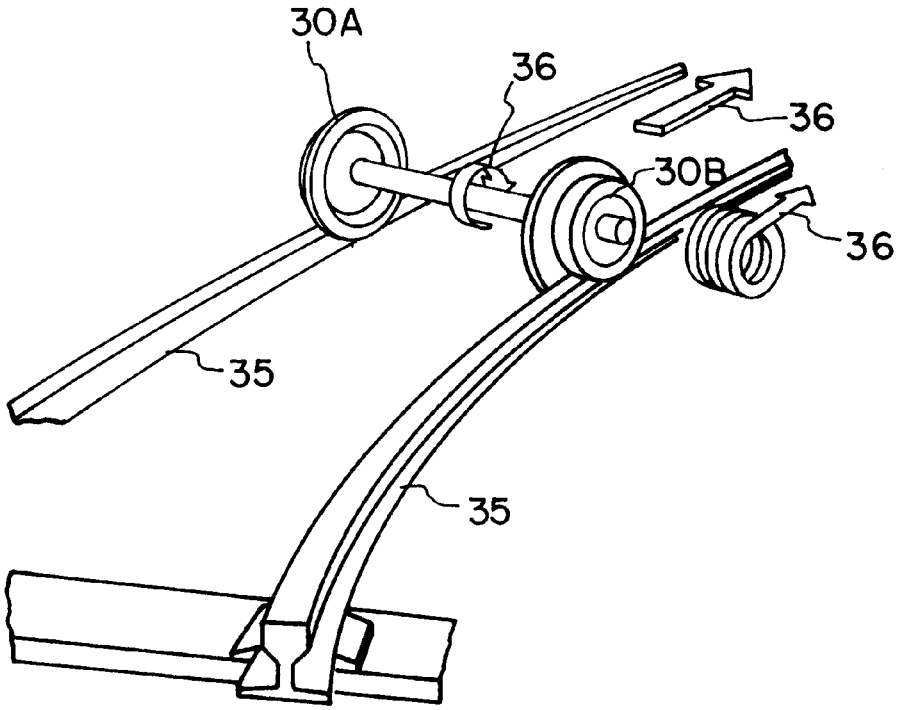
FIG. 8 is a perspective view of the wheel and axle assembly of FIG. 7 shown traversing a curved section of railroad track.

This standard railroad axle and wheel configuration inherently causes a spinning/dragging problem when being rolled on a curved train track 35 as illustrated in FIG. 8. In this situation the wheel 30A to the outside of the curve must travel a longer distance along the track 35 than the wheel 30B to the inside curve causing it to spin on the inside track while the wheel 30A is dragged along the outside rail.

This dragging/spinning problem is well known to railroad engineers and costs the railway industry millions of dollars annually in repairs to both wheels and track and the associated maintenance and labor costs.

Figure 9:
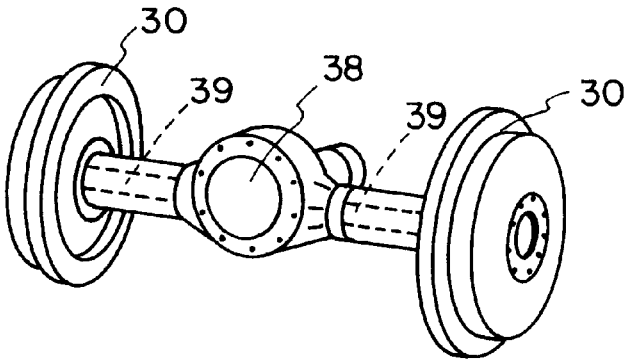
FIG. 9 is a perspective view of an automotive/truck type differential axle of the present invention having railroad wheels mounted thereon.

This problem is effectively eliminated by the use of a conventional automotive or truck rear axle as depicted in FIG. 9 wherein each wheel turns independently on a separate axle shaft 39 which engages the differential 38. The differential 38 permits the difference in rotational speed of the axles and wheels around a curve.

This automotive type wheel/axle configuration will be utilized in the lead drive unit 20 and the secondary drive unit 25 of the Super Rail Train. Use of the truck/automotive type drive axle virtually eliminates the dragging/spinning problem described hereinabove and significantly reduces the maintenance and repair costs associated with the problem.

The use of multiple drive axles in the lead drive unit 20 and the secondary drive units 25 enables the tractive effort to be distributed along the entire length of the Super Rail Train during peak load conditions such as starting from a dead stop and pulling uphill grades. The multiple drive axles are mechanically interconnected by the use of a Power Divider (not shown) which apportions the driving effort to all axles 29 to provide maximum tractive effort on demand.

Since such Power Dividers are well known to those skilled in the art, further detailed discussion of the same is not deemed necessary.

Figure 10:
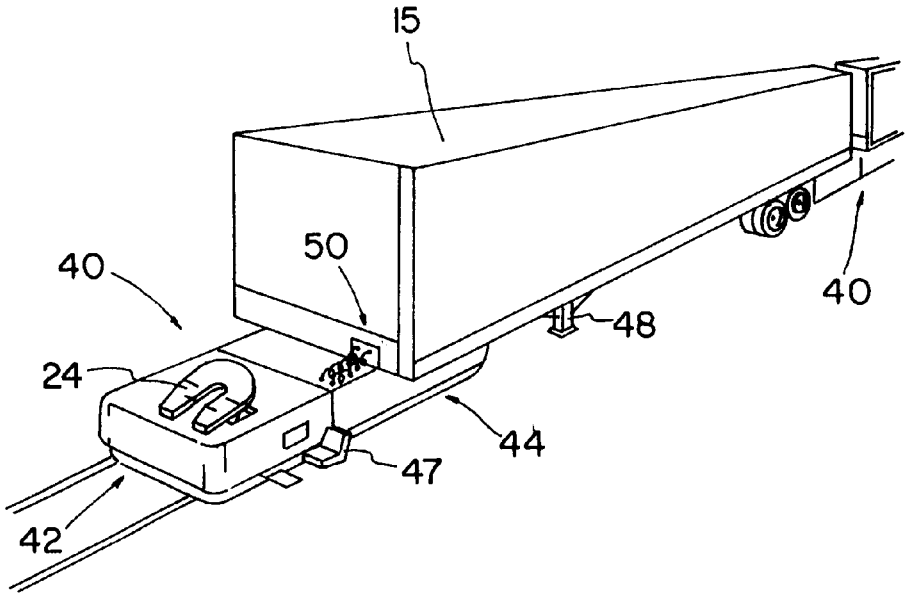
FIG. 10 is a perspective view showing a tandem device of the present invention coupled to a semi-trailer container of the type used in the present system.

Another novel feature of the Super Rail System is the tandem device, indicated generally at 40 and illustrated in FIG. 10. The tandem device 40 provides numerous advantages to the Super Rail System.

Figure 11:
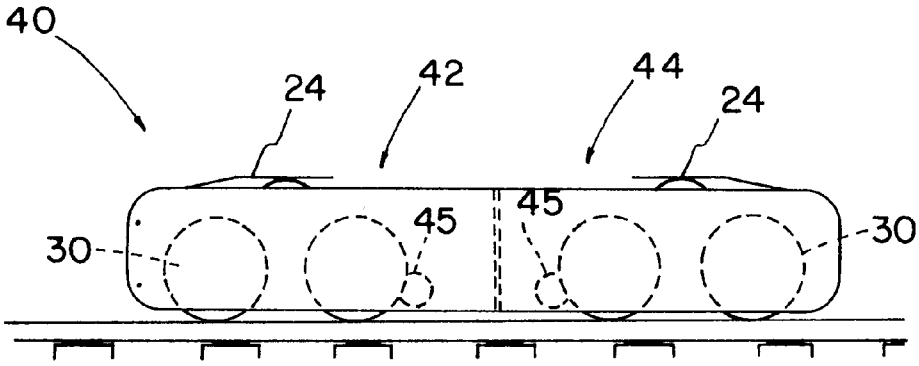
FIG. 11 is a side elevational view of the tandem device of the present invention showing the arrangement of the axles and the small drive engine thereof.

Each tandem device 40 includes two separate self-powered modules i.e. a forward module, indicated generally at 42 and a rear module, indicated generally at 44 as shown in FIG. 10. Each module includes a small drive motor 45 as shown in FIG. 11 and is equipped with operator controls to allow an operator to move up to five fully loaded trailer containers 15 by rail during the hitching and unhitching process without the aid of a train locomotive or truck tractor.

However, the forward module 42 of each tandem device 40 is provided with a detachable railroad coupling (not shown) capable of engagement with a locomotive hitch (not shown) to make the present system compatible with standard rail equipment.

Each tandem device 40 includes four highway type straight axles 54 rated at 25,000 pounds to provide a gross vehicle weight capacity of 100,000 pounds. The average highway trailer 15 container including a full load is 50,000 to 65,000 pounds which can be easily handled by an individual module 42 or 44 when secured to the fifth wheel unit 24 carried on each module.

The modules 42 and 44 are interconnected by an air hitch mechanism (not shown) that operates off of the compressed air system of the train shown in FIG. 9. Thus, when disconnected from the compressed air supply, the individual modules 42 and 44 can be separately operated and controlled from a foldout driver's seat 47.

Figure 12:
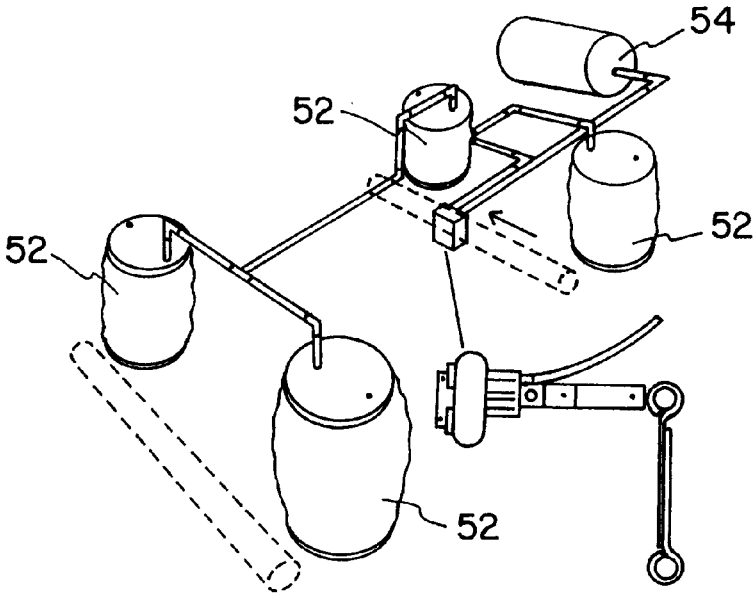
FIG. 12 is a perspective view of the air spring system utilized on-board the tandem device.

In the preferred embodiment the tandem device 40 is equipped with an air spring or air-ride system illustrated in FIG. 12. In this system a plurality of air springs 52 supplied by an on-board air compressor (not shown) and a reservoir 54 of compressed air function to raise and lower the fifth wheel units 24 into and out of engagement with the kingpin 22 of a trailer container 15 during the hitching or unhitching process.

The air spring system is also utilized to lift a wheel/axle assembly of the tandem 40 off the railroad track when it is in need of repairs until the tandem device 40 can be switched out at a repair terminal along the railroad line. Thus, in the case of an axle or wheel failure, the affected axle 54 can be lifted clear of the track as shown in FIG. 14 to permit the train to continue on its run at a reduced speed until arrival at a repair terminal.

Figure 13:
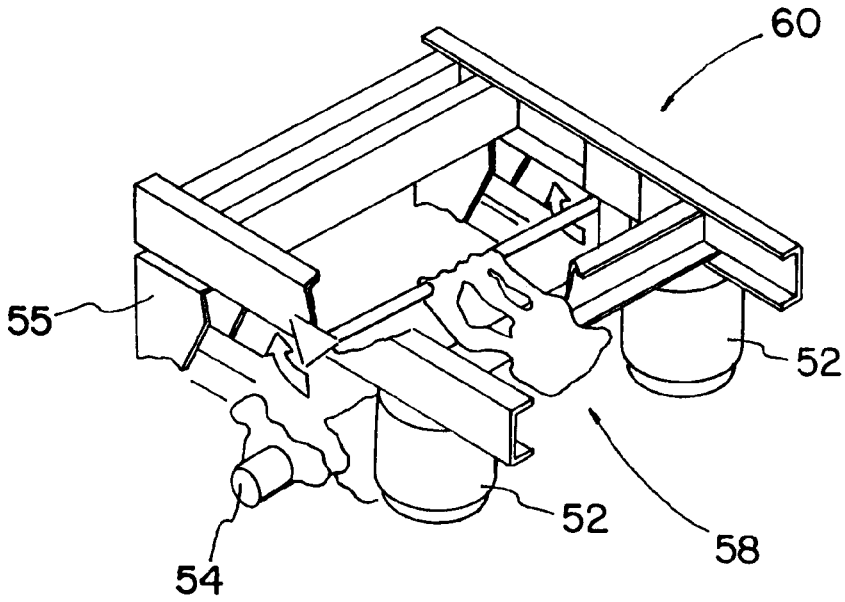
FIG. 13 is a perspective view of a section of the support frame of the tandem device showing an axle locking mechanism with the axle in a deployed condition.

As shown in FIG. 13 the tandem 40 includes a generally rectangular frame, indicated generally at 60 whereon the individual straight axles 54 are pivotally mounted on axle supports 55.

Figure 14:
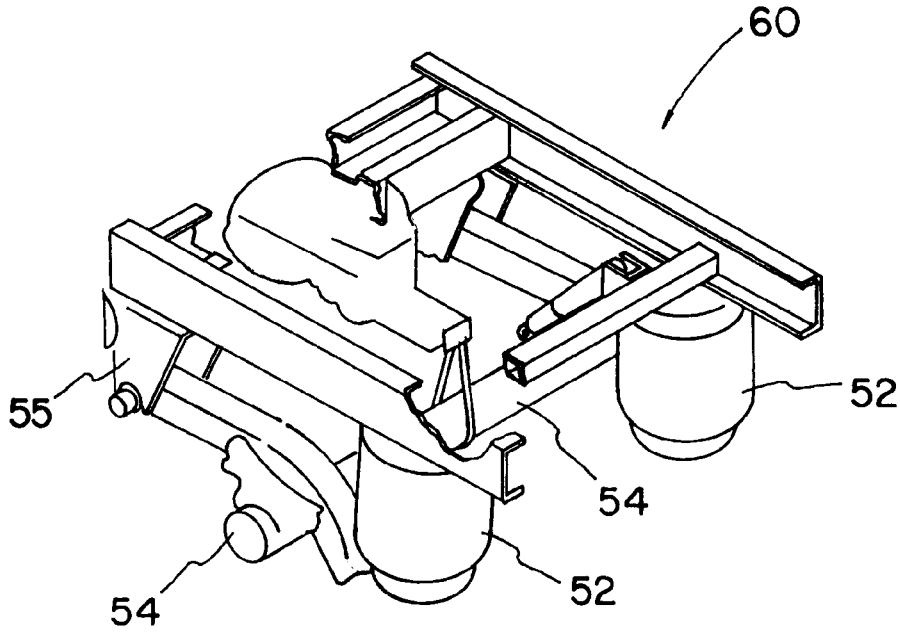
FIG. 14 is a perspective view of a section of the supporting frame of the tandem device showing an axle thereof in an upwardly retracted condition.

Each axle 54 is provided with a locking mechanism, indicated generally at 58 which is also pivotally attached to the frame 60 to permit the axle 54 to be locked down into contact with the railroad track as shown in FIG. 13 or, in the alternative, lifted up into a retracted position as shown in FIG. 14 when temporarily out of service.

An air braking system (not shown) is also utilized on the tandem device 40 to ensure adequate stopping control and to prevent brake lockups. The brake system also contributes to reduced track and wheel wear.

The method of assembling a train of truck trailers 15 will now be described in detail. In the prior art truck-train systems described hereinabove after the highway trailer has been attached to a railway dolly or bogie using separate lifting devices or special mechanical devices incorporated into the dolly itself, a so-called switching engine (not shown) is required to transport the assembled train of highway trailers and bogies to the rest of the train. In the alternative the train locomotive can move sections of the train into position for hitching. In the present invention this function is accomplished by the tandem device 40 without the need for a separate switching engine.

Figure 15:
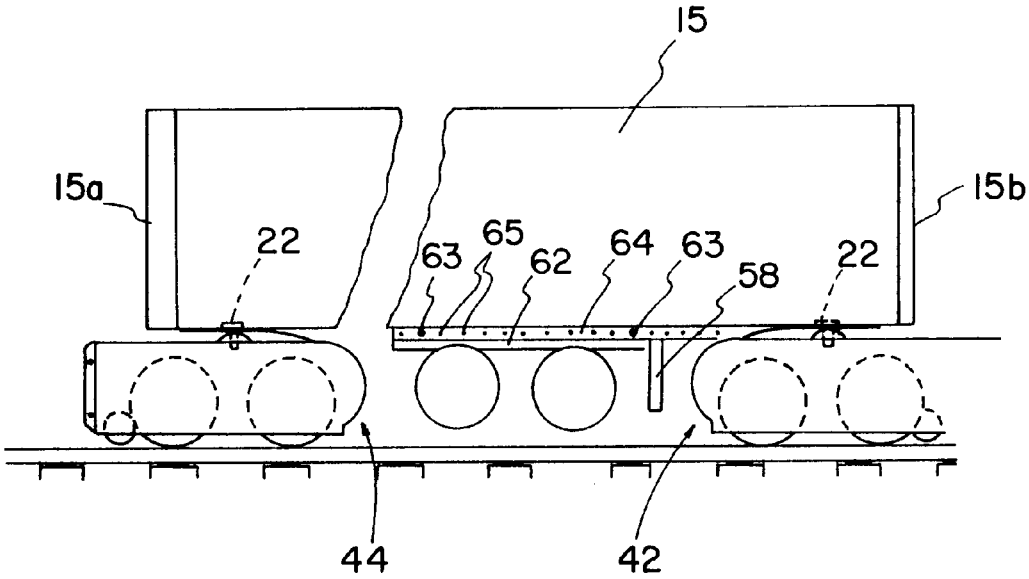
FIG. 15 is a side elevational view of a semi-trailer container of the present invention showing the rear and front modules of the tandem device attached thereto.

Initially, in order to be compatible with a tandem device 40 the highway trailer container 15 must of the type wherein the rear axles are capable of sliding forward and rearward with respect to the body of the trailer container 15 as shown in FIG. 15. This is accomplished by use of a sliding axle carriage frame 62 which engages a mating undercarriage 64 that is attached to a bottom surface of the trailer container 15. A plurality of apertures 65 formed in the frames 62 and the undercarriage 64 are brought into alignment and a carriage pin 63 is inserted therethrough to secure the axles in the desired position to properly distribute the load.

The repositioning of such a sliding axle carriage is typically carried out by removing the pins 63 from the axle carriage frame 62 and driving the tractor trailer rig in either a forward or reverse direction until the desired position is achieved and the pins 63 can be replaced.

Figure 16:
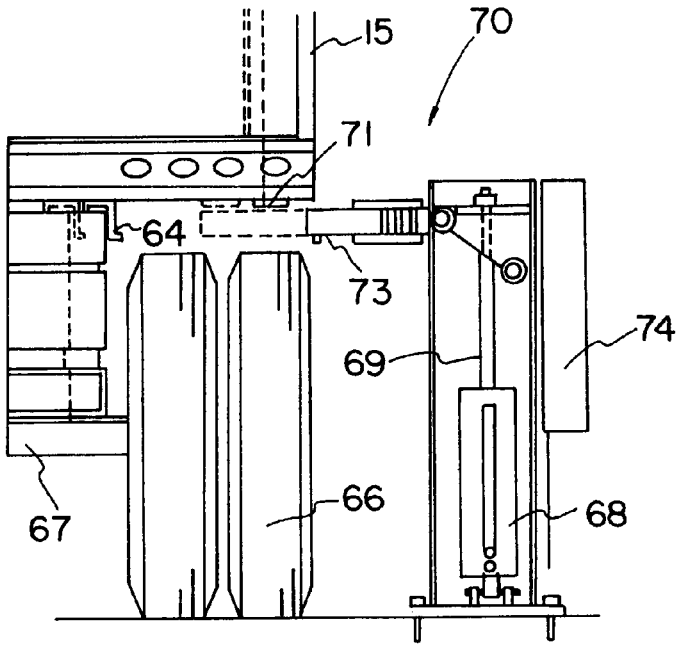
FIG. 16 is a rear elevation of a semi-trailer container of the present invention shown in proximity to a staging device of the present system.

However, this procedure is more easily accomplished in the present system by the use of a staging device, indicated generally at 70 and shown in FIG. 16, which is a lifting device that engages the trailer container 15 at a pad member 71 mechanically coupled to an underside of the trailer container 15 adjacent the undercarriage 64. The staging device 70 is essentially a pneumatic/hydraulic jack mechanism which lifts the truck container 15 to take the weight off the trailer container wheels 66 and axle 67 to facilitate changing the position of the axles.

The staging device includes a pneumatic/hydraulic cylinder 68 including an extendable piston 69 that is mechanically coupled to an adjustable lift arm 73 which is designed to engage the pad member 71 during the lifting operation.

The lift arm 73 is capable of horizontal movement as shown in phantom outline in FIG. 16 to accommodate trailer containers 15 of different widths.

A control box 74 encloses the electronic components and circuitry necessary to provide the functions of the staging device 70.

Figure 17:
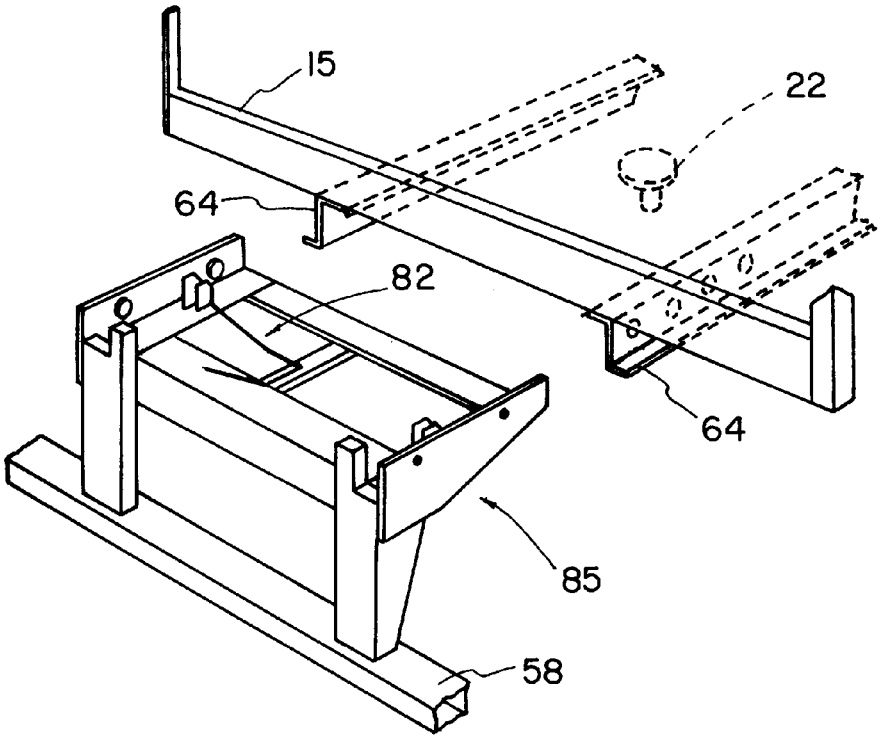
FIG. 17 is an exploded perspective view of the sliding rear bumper assembly of the present invention.

In addition to the sliding axle equipment described hereinabove, a trailer container 15 must also be equipped with a rear kingpin 22 as shown in FIG. 17 suitable for engagement with the standard fifth wheel unit 24 carried on the tandem device 40. Such a kingpin 22 will be installed as standard equipment on all of the trailer containers 15 of the Super Rail System and can easily be retrofit to adapt to pre-existing trailer containers of the present system. Of course, a kingpin 22 is carried as standard equipment at the forward end 15*a* of virtually all tractor trailer containers presently on the road.

Further, a trailer container 15 compatible with the present system will require that the rear bumper 58 of trailer container 15 also be capable of forward sliding movement to the position shown in FIG. 15 to provide clearance for the tandem device 40 to be installed under the rearward end 15*b* of the trailer container.

In the preferred embodiment the rear bumper 58 is adapted for sliding movement from its normal position adjacent the rear end 15*b* of the trailer container by a sliding bumper frame assembly, indicated generally at 85 and illustrated in FIG. 17. The bumper frame assembly 85 which attaches to the rear bumper 58 is adapted for sliding engagement with the undercarriage 64 attached to the bottom surface of the trailer container 15. The bumper frame assembly 85 includes a quick release mechanism, indicated generally at 82 which permits the entire bumper assembly to be slid forward of the kingpin 22 to provide clearance for the tandem device 40 during the hitching process.

In a basic assembly procedure of the Super Rail Train of the present system, the trailer container 15 is drawn into a position in alignment with the railway tracks 35 at a terminal loading ramp and detached from the highway truck-tractor (not shown). The separated modules 42 and 44 of the tandem device 40 are positioned on the track on either side of the trailer container 15 and driven by an operator under both ends thereof ensuring that sufficient clearance is available.

Thereafter, the air spring system of the tandem device 40 is actuated such that the tandem device is raised into a position of engagement with the respective kingpins 22 raising the trailer container 15 off the ground to the position shown in FIG. 15.

Thereafter, the loaded container 15 may be driven by an operator utilizing either module 42 or 44 and connected with a mating module on the next adjacent trailer container 15 in the train.

It will be understood that in the present system the rearward tandem module 44 will always be disposed at the forward end 15*a* of a trailer container 15 and the forward tandem module 42 will always be disposed at the rearward end 15*b* of a trailer container 15 as shown in FIG. 15 to ensure mating engagement between adjacent containers 15 in the train.

Figure 18:
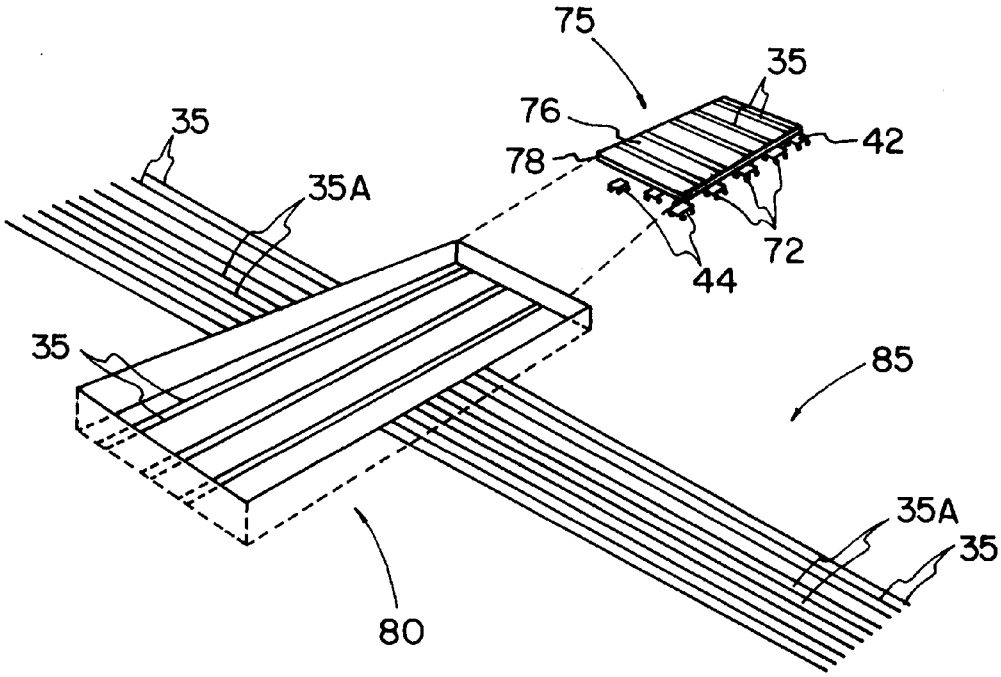
FIG. 18 is an exploded perspective view of the switching ramp of the present invention and the pit structure wherein it is deployed in transverse relation to the railroad tracks.

Another novel feature of the Super Rail System of the present invention is a specially designed switching ramp, indicated generally at 75 and shown in FIG. 18 which functions to expedite hitching and unhitching of trailer containers 15 upon arrival or departure from the Super Rail Train.

In the preferred embodiment, the switching ramp 75 is a generally rectangular concrete slab structure 76 wherein a plurality of parallel sets of railway tracks 35 are embedded. The slab structure 76 is a steel reinforced construction and surrounded by a supporting frame 78.

The slab structure 76 is of sufficient capacity and dimensions to support a plurality of loaded trailer containers 15 during the hitching and unhitching procedure upon joining or departing from the train.

The switching ramp 75 is designed to traverse a pit structure, indicated generally at 80 to move the ramp 75 into alignment with adjacent parallel sets of tracks 35 disposed in the terminal yard, indicated generally at 85, for routing to other trains or for conversion back to highway use.

The pit structure 80 is also a generally rectangular concrete construction having a plurality of sets of parallel railway tracks 35 embedded therein. The pit structure is of sufficient length to permit both end tracks 35 on the slab 76 to be brought into alignment with all of the parallel sets of tracks which are interrupted by the pit 80 as shown in FIG. 18.

The slab 76 is adapted for rolling movement within the pit structure 80 being mounted on a plurality of railroad bogie devices 72 or other similar devices having sufficient load capacity to support the weight of the slab 76 and the fully loaded trailer containers 15. In addition, one or more tandem modules 42 or 44 are attached at either end of the slab to pull the same during operation.

Since such railway dollies or bogie devices are well known to those skilled in the art, further detailed discussion of the same is not deemed necessary.

Figure 19:
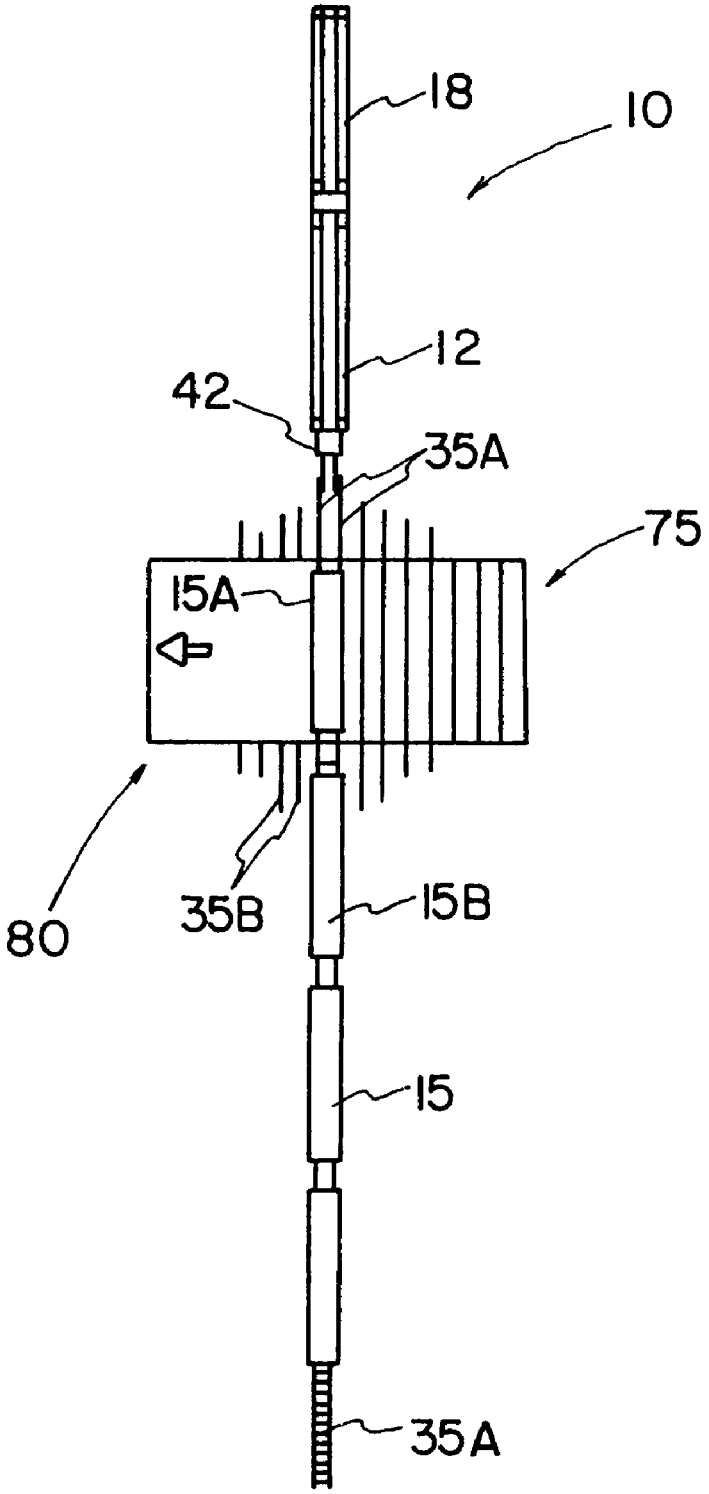
FIG. 19 is a plan view of the switching ramp of the present system showing a trailer container deployed thereon for disassembly from the train.

The switching ramp 75 will be installed at various terminal locations along the route served by the Super Rail System. In practical use as a Super Rail Train arrives at the terminal on the main railway track 35A, the train crosses over the ramp 75 and stops at a position wherein the first trailer container 15 to be unloaded from the train is positioned on the ramp 75 as shown in FIG. 19. It will be noted that the train is positioned on the first set of tracks of the ramp 75.

A first tandem device 40 disposed at the juncture of the last passenger coach 12 and the first trailer 15A is separated into modules 42 and 44 and the passenger coach 12 together with the primary drive vehicle 18 proceeds to the terminal to unload and reload the passengers.

Thereafter, the passenger portion of the train 10 will return to the ramp for a different trailer train or proceed to its destination depending upon its schedule. It will be noted that such additional trailer trains have been omitted from the drawings for purposes of this explanation.

Next, the first trailer container 15A on the ramp 75 is unhooked from the remaining portion of the trailer train which is backed clear of the ramp 75.

Figure 20:
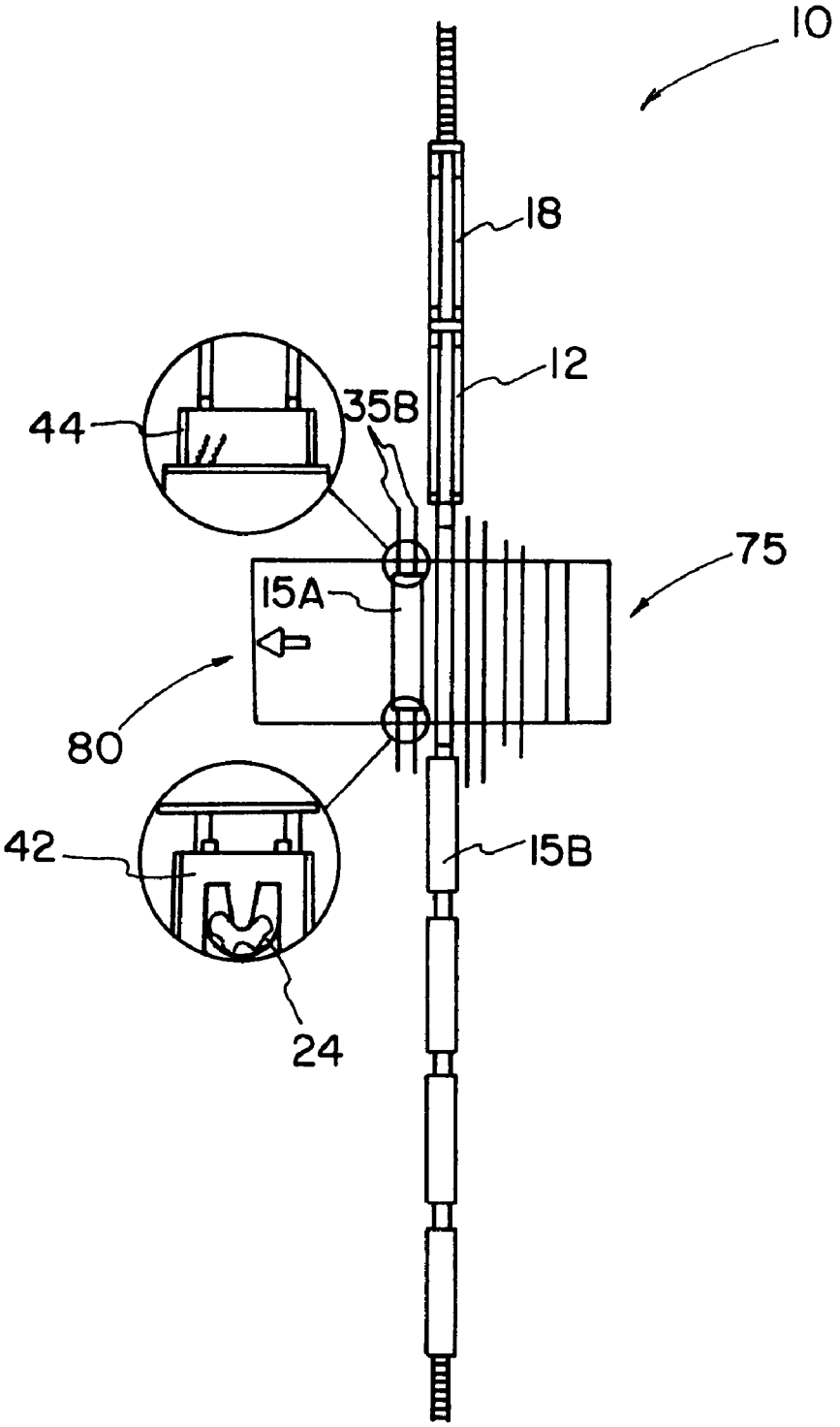
FIG. 20 is a plan view of the switching ramp of the present system showing a trailer container being shifted on the ramp into alignment with an adjacent railroad track parallel to the main railroad track.

Thereafter, the ramp 75 is shifted to the left to align with the next adjacent set of tracks 35B as shown in FIG. 20. The operator now lowers the landing gear 48 of the trailer container 15 and unhitches the tandem modules 42 and 44 by releasing their respective fifth wheel units 24.

Figure 21:
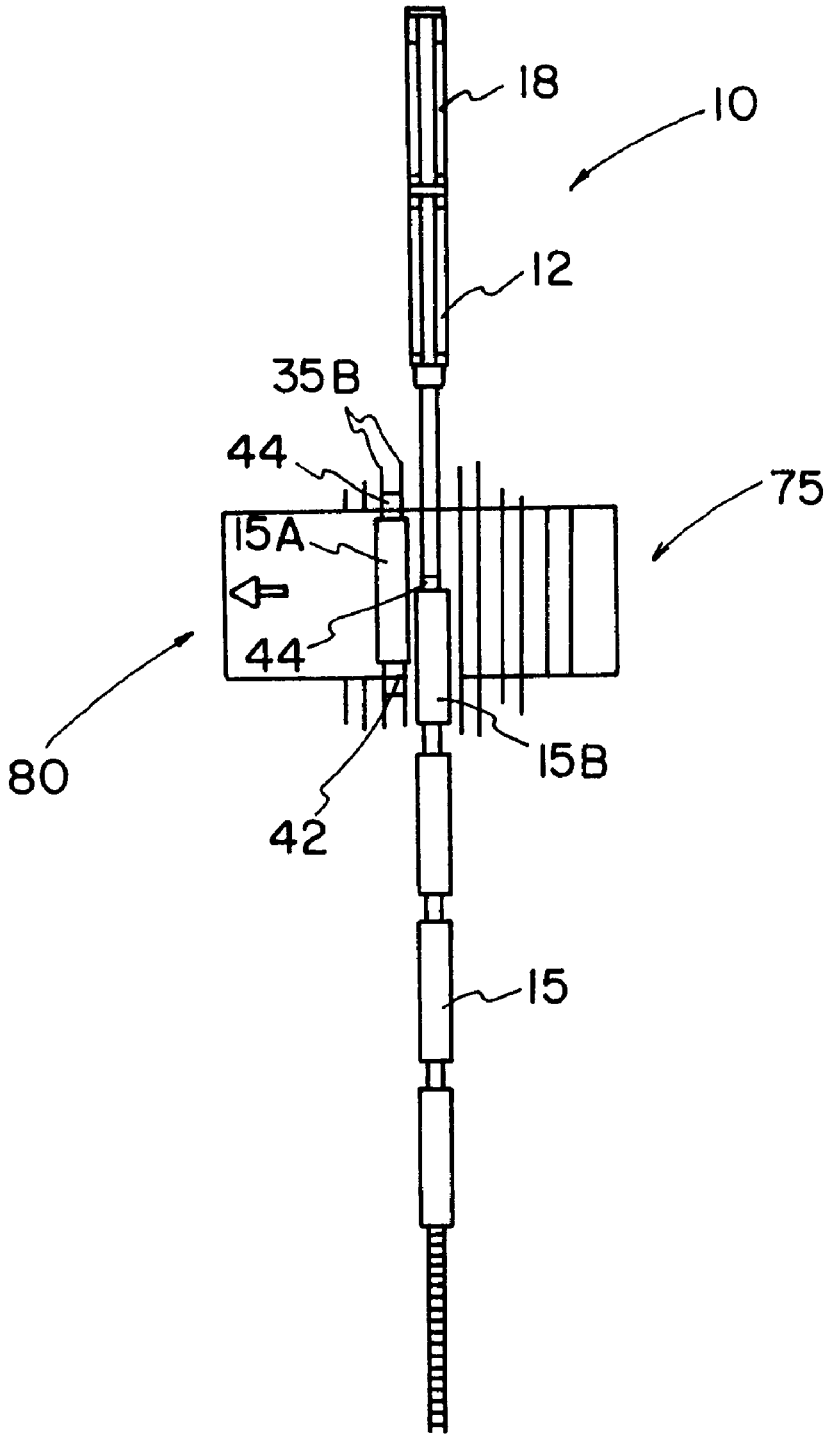
FIG. 21 is a plan view of the switching ramp whereon a second semi-trailer container is being loaded for disassembly from the remainder of the train.

Next, each of the tandem modules 42 and 44 are backed off of the ramp 75 on to aligned tracks 35B as shown in FIG. 21 where the modules 42 and 44 will remain until needed for the next trailer container 15 to be placed on the ramp 75 for routing.

Figure 22:
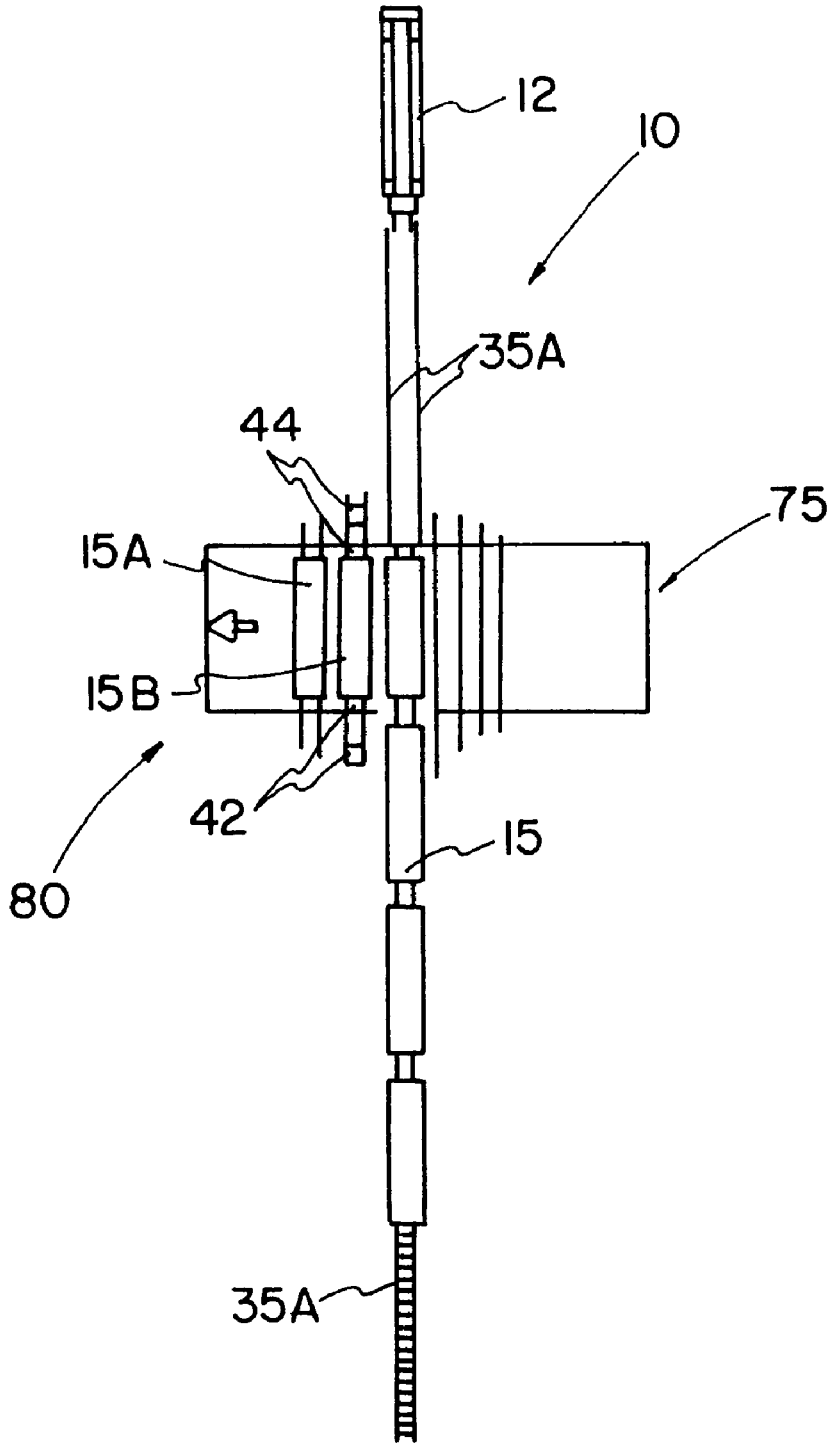
FIG. 22 is a plan view of a third semi-trailer container being loaded onto the switching ramp for disassembly from the remainder of the train.
Figure 2C:
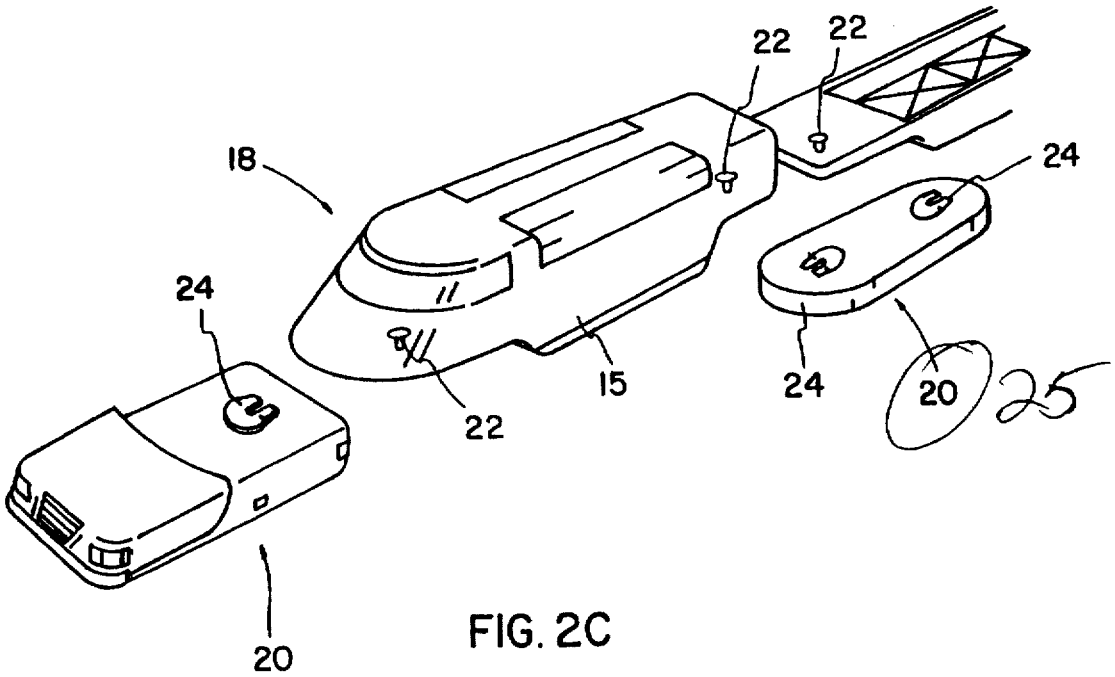
Figure 3A:
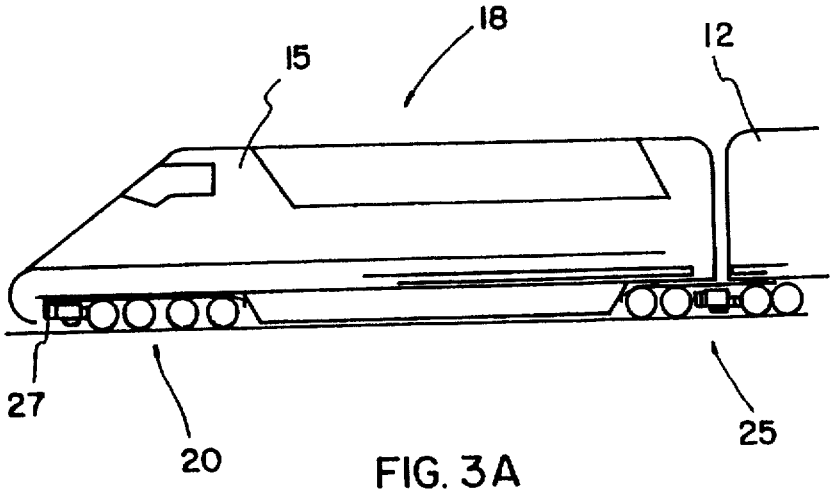

Simultaneously, the second trailer container 15B in the train is driven onto the second set of tracks of the ramp 75 using its attached tandem module 44 as shown in FIG. 21. When this trailer container 15B is properly positioned on the ramp 75, the operator of the tandem module will stop and unhook the container 15B from the train by separating the tandem modules 42 and 44 at the rear end thereof. The remaining portion of the trailer train is backed up until it clears the ramp 75 and the ramp is again shifted to the left until the second container 15B is aligned with the tracks 35B adjacent to the main track 35A as shown in FIG. 22.

In similar fashion the landing gear 48 of the second container 75B is lowered and the tandem modules 42 and 44 are released by lowering their respective fifth wheel units 24 and the modules are backed off of the ramp 75 by the operator.

It will be appreciated by those skilled in the art that this process is repeated until all of the trailer containers 15 which are to be unhooked from the train at a particular location have been moved to adjacent tracks for routing to other trains or back to highway use.

The tandem modules 42 and 44 accumulated on the side tracks 35B are stored for future use and the above process is essentially reversed to create new trailer container trains for transport on the present system.

From the above it can be seen that the Super Rail System of the present invention provides an improved intermodal transport system combining trucking and railway technology.

The present system includes a Super Rail Train which offers the advantages of highway type drive train and suspension systems which are more cost efficient and maintenance free than conventional railway locomotives.

The Super Rail System provides novel features such as a secondary power unit controlled by an on-board computer system which operates during peak load conditions. The present system also provides a unique, self-powered tandem device which replaces the conventional railway dolly or bogie in the transport of highway trailer containers.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. An intermodal transport system comprising;

a primary drive vehicle for use on railway rails having an automotive truck drive system including a diesel engine and transmission which are operatively connected to a plurality of differential drive axles, and a rear fifth wheel unit for loading and unloading various system components;

a plurality of passenger coaches for use on said rails;

a plurality of semi-trailer containers including sliding tandem axle systems and front and rear kingpins;

a plurality of secondary drive vehicles for use on said rails each having a highway truck drive system including a diesel engine and transmission which are operatively connected to a plurality of differential axles, and a pair of rear and forward fifth wheel units for loading and unloading various system components, said secondary drive vehicles being disposed between and interconnecting said passenger coaches to form a train; and a plurality of self-powered tandem devices for use on said rails each having a plurality of straight highway axles and a pair of fifth wheel units, said tandem devices being disposed between and interconnecting said semi-trailer containers, said tandem devices being equipped with a pneumatic system to raise and lower said tandem devices into and out of supporting engagement with said trailer containers such that said primary drive vehicle, said passenger coaches, said secondary drive vehicles, said trailer containers and said tandem devices can be selectively assembled to form a train for use in transporting passengers and freight by rail.

2. The intermodal transport system of claim 1 wherein a switching ramp means is provided for use with said system, said switching ramp means comprising a generally rectangular concrete structure having multiple sets of parallel railroad tracks embedded therein, said switching ramp means being adapted for reciprocating movement in perpendicular relation to a main railroad track for hitching and unhitching said trailer containers at a railway terminal whereby said train can be disassembled and said highway trailer containers routed for highway transport.

3. The intermodal transport system of claim 2 wherein said switching ramp means is supported by a plurality of railroad bogie devices for use on rails, said switching ramp means being moved in perpendicular relation to said main railroad track by a plurality of said tandem devices mechanically coupled thereto.

4. The intermodal transport system of claim 1 wherein each of said differential axles of said primary drive vehicle include a pair of railroad wheels, each of said axles being mechanically coupled together enabling each wheel thereof to selectively provide tractive force during operation.

5. The intermodal transport system of claim 4 wherein each of said wheels on each of said axles is capable of rotating at a different speed when said primary drive vehicle traverses a curved section of railway track during operation.

6. The intermodal transport system of claim 1 wherein each of said axles of said secondary drive vehicles is mechanically coupled to at least one other of said axles, each of said axles including a pair of wheels capable of providing tractive effort during operation.

7. The intermodal transport system of claim 6 wherein each of said pair of wheels on said axle is capable of rotation at different speeds when said secondary drive vehicle travels on a curved section of said track.

8. The intermodal transport system of claim 1 wherein each of said tandem devices is separable into two tandem modules along a mid-section thereof by a pneumatic hitching means.

9. The intermodal transport system of claim 8 wherein each of said tandem modules is powered by a small internal combustion engine capable of moving a plurality of said highway trailer containers.

10. The intermodal transport system of claim 9 wherein each of tandem modules is equipped with an air spring mechanism capable of raising and lowering said fifth wheel units of said modules into engagement with a kingpin located at a front and back underside end of said trailer containers.

11. The intermodal transport system of claim 1 wherein said engine and transmission of said primary drive vehicles are assembled in a modular configuration so as to be removable from said primary drive vehicle as an assembled unit.

12. The intermodal transport system of claim 11 wherein said plurality of differential axles of said primary drive vehicle are assembled in a modular configuration so as to be removable from said primary drive vehicle as an assembled unit.

13. The intermodal transport system of claim 1 wherein said highway trailer containers are provided with a sliding rear bumper wherein said bumper is capable of forward and rearward movement along a longitudinal axis of said container to provide clearance for said tandem devices during a hitching process.

* * * * *

UNITED STATES PATENT AND TRADEMARK OFFICE

CERTIFICATE OF CORRECTION

PATENT NO. : 6,123,029
DATED : September 26, 2000
INVENTOR(S) : Joseph T. Mobley It is certified that error appears in the above-identified patent and that said Letters Patent is hereby corrected as shown below:

Fig. 2C #20 (between # 24 and #24) on the right side of drawing should be #25

Column 5,
Lines 46 and 57 cab 13 should be cab 18

Signed and Sealed this

Twenty-third Day of October, 2001

*Attest:*

Nicholas P. Godici

NICHOLAS P. GODICI
*Acting Director of the United States Patent and Trademark Office*

*Attesting Officer*